US010086257B2

(12) United States Patent
Mehiel

(10) Patent No.: US 10,086,257 B2
(45) Date of Patent: Oct. 2, 2018

(54) APPARATUS FOR ADAPTING A SNOWBOARD BOOT FOR USE WITH AN ALPINE SKI

(71) Applicant: MAD JACK SNOW SPORTS, Los Osos, CA (US)

(72) Inventor: Eric Mehiel, Los Osos, CA (US)

(73) Assignee: Mad Jack Snow Sports, Los Osos, CA (US)

( * ) Notice: Subject to any disclaimer, the term of this patent is extended or adjusted under 35 U.S.C. 154(b) by 0 days.

(21) Appl. No.: 15/632,228

(22) Filed: Jun. 23, 2017

(65) Prior Publication Data

US 2017/0368445 A1 Dec. 28, 2017

Related U.S. Application Data

(60) Provisional application No. 62/355,573, filed on Jun. 28, 2016.

(51) Int. Cl.

| | |
|---|---|
| ***A63C 9/00*** | (2012.01) |
| ***A63C 10/14*** | (2012.01) |
| ***A43B 5/04*** | (2006.01) |
| ***A63C 10/24*** | (2012.01) |
| ***A63C 10/06*** | (2012.01) |

(52) U.S. Cl.

CPC ..... *A63C 10/145* (2013.01); *A43B 5/0401* (2013.01); *A63C 9/00* (2013.01); *A63C 10/06* (2013.01); *A63C 10/24* (2013.01); *A63C 2203/065* (2013.01)

(58) Field of Classification Search

CPC ..... A63C 5/031; A63C 10/08; A63C 10/20; A63C 10/22; A63C 10/28

USPC ..... 280/14.22, 14.24

See application file for complete search history.

(56) References Cited

U.S. PATENT DOCUMENTS

| | | | | |
|---|---|---|---|---|
| 3,854,743 A | | 12/1974 | Hansen | |
| 4,002,354 A | | 1/1977 | Ramer | |
| 4,367,885 A | | 1/1983 | Ramer | |
| 5,142,798 A | | 9/1992 | Kaufman | |
| 5,261,689 A | * | 11/1993 | Carpenter | A63C 10/24 280/14.24 |
| 5,344,178 A | * | 9/1994 | Rohrmoser | A63C 9/00 280/617 |
| 5,344,179 A | * | 9/1994 | Fritschi | A63C 10/08 280/14.21 |

(Continued)

FOREIGN PATENT DOCUMENTS

WO 2009097550 8/2009

OTHER PUBLICATIONS

Schroeder; U.S. Appl. No. 62/261,686, filed Dec. 1, 2015.

*Primary Examiner* — Jeffrey J Restifo

(74) *Attorney, Agent, or Firm* — Fitch, Even, Tabin & Flannery, LLP

(57) ABSTRACT

An adjustable ski binding adapter apparatus that adapt a snowboard boot for use with alpine ski bindings. The ski binding adapter apparatus includes a back support pivotally coupled to a sole plate, where the back support pivots to aid in stepping into the ski binding adapter apparatus. The sole plate is adjustable for length. Adjustable strap assemblies are coupled to the sole plate and the back support and snugly encircle and restrain the boot in the ski binding adapter apparatus. The back support and the sole plate are configured to conform to ski boot standards and attach to a conventional ski binding.

16 Claims, 8 Drawing Sheets

(56) References Cited

U.S. PATENT DOCUMENTS 5,505,478 A * 4/1996 Napoliello ..... A63C 10/10 280/14.22
5,556,123 A * 9/1996 Fournier ..... A63C 10/04 280/14.24
5,649,722 A * 7/1997 Champlin ..... A63C 5/02 280/14.22
5,741,023 A * 4/1998 Schiele ..... A63C 9/02 280/14.21
5,815,953 A 10/1998 Kaufman
5,890,730 A * 4/1999 Anderson ..... A63C 10/10 280/14.22
5,971,407 A * 10/1999 Zemke ..... A63C 10/285 280/14.22
5,984,324 A * 11/1999 Wariakois ..... A63C 5/02 280/14.24
6,056,300 A * 5/2000 Carpenter ..... A63C 10/04 24/DIG. 51
6,126,190 A 10/2000 Viodet
6,142,503 A * 11/2000 Forest ..... A63C 10/02 280/14.24
6,283,482 B1 * 9/2001 Coulter ..... A63C 10/22 280/14.22
6,523,851 B1 * 2/2003 Maravetz ..... A63C 5/02 280/14.22
6,554,295 B2 4/2003 Rittmeyer
6,554,296 B1 * 4/2003 Laughlin ..... A63C 10/10 280/14.22
6,575,490 B1 * 6/2003 Laughlin ..... A63C 10/22 280/14.24
6,581,944 B1 * 6/2003 Marmonier ..... A63C 10/22 280/14.22
6,669,211 B2 * 12/2003 Gonthier ..... A63C 10/04 280/11.3
6,773,020 B2 * 8/2004 Gonthier ..... A63C 10/06 280/14.21
6,863,285 B2 3/2005 Gonthier
6,886,849 B2 * 5/2005 Mandon ..... A63C 10/04 280/14.22
6,955,362 B2 * 10/2005 Bazzi ..... A63C 10/04 280/14.22
7,011,334 B2 * 3/2006 Holzer ..... A63C 10/10 280/11.3
7,216,889 B2 * 5/2007 Haupt ..... A63C 10/22 280/11.26
7,232,132 B2 * 6/2007 Elkington ..... A63C 10/04 280/11.3
7,246,811 B2 * 7/2007 Martin ..... A63C 10/04 280/14.22
7,287,776 B2 * 10/2007 Papon ..... A63C 10/20 280/14.22
7,427,079 B2 * 9/2008 Piva ..... A63C 10/04 280/14.24
7,494,148 B2 * 2/2009 Muscatelli ..... A63C 10/06 280/14.21
7,520,526 B2 * 4/2009 Muscatelli ..... A63C 10/06 280/14.22
7,621,542 B2 * 11/2009 Warburton ..... A63C 10/24 280/14.21
7,823,905 B2 * 11/2010 Ritter ..... A63C 5/02 280/14.26
8,075,015 B2 * 12/2011 Fumagalli ..... A63C 10/06 280/14.22
8,146,940 B2 * 4/2012 Hahnenberger ..... A63C 10/06 280/14.21
8,226,109 B2 * 7/2012 Ritter ..... A63C 5/02 280/14.26
8,469,372 B2 * 6/2013 Kloster ..... A63C 5/02 280/14.22
8,573,631 B2 * 11/2013 Rancon ..... A63C 10/24 280/14.22
8,684,394 B2 * 4/2014 Smith ..... A63C 10/24 280/14.22
8,708,371 B2 * 4/2014 Balun ..... A63C 5/033 280/14.21
8,720,910 B2 * 5/2014 Caslowitz ..... A43B 5/16 24/70 SK
8,764,043 B2 * 7/2014 Neubauer ..... A63C 10/16 280/607
8,910,968 B2 * 12/2014 Pelchat ..... A63C 10/005 280/14.22
8,960,710 B2 * 2/2015 Pascal ..... A63C 10/24 280/14.24
9,022,412 B2 * 5/2015 Ritter ..... A63C 5/02 280/14.26
9,126,099 B2 * 9/2015 Ritter ..... A63C 5/02
9,545,560 B2 * 1/2017 Chen ..... B63B 35/812
2003/0094789 A1 5/2003 Poscich
2017/0151488 A1 6/2017 Schroeder

* cited by examiner

APPARATUS FOR ADAPTING A SNOWBOARD BOOT FOR USE WITH AN ALPINE SKI

This application claims the benefit of U.S. Provisional Application No. 62/355,573, filed Jun. 28, 2016, entitled Adjustable toe guide, foot strap and hinged back support and a system that adapts a snowboard boot to an alpine ski binding, which is incorporated in its entirety herein by reference.

BACKGROUND OF THE INVENTION

Field of the Invention

The present invention relates generally to devices for adapting footwear for other uses, and more specifically to adapting footwear for use with a ski binding. Even more specifically, the present invention relates to adapting a snowboard boot for use with a ski binding.

Discussion of the Related Art

There are many known alpine ski boots, bindings and skis. All of these alpine boots and bindings conform to the corresponding ISO and ASTM standards, which define parameters such as geometry and release torques. Many designs for how a skier enters the boot and how the boot is closed (or buckled) have been developed over a long time period. Also, many different designs for alpine ski bindings have also been developed during the same time frame. The standards of the alpine ski boots and alpine ski bindings ensure that the alpine ski boot will function properly in the ski binding, Snowboard boots are fundamentally different than alpine ski boots. Snowboard boots do not have a hard shell, and while the snowboard boots are normally stiffer than a standard outdoor boot (for hiking for example) they tend to be less stiff than a normal alpine ski boot. In addition, snowboard boots do not embody the geometry and structural features required for alpine ski boots and are not designed to engage with a standard alpine ski binding. Snowboard boots and bindings must also adhere to the applicable ISO and ASTM standards regarding geometry, but the type of fit and fit tolerances are significantly different than those for alpine ski bindings. Snowboard boots use a "bucket fit" to engage with standard snowboard bindings. A "bucket fit" refers to the snowboard boot being placed in a snowboard binding which is essentially a concave shell so the snowboard boot is held roughly in place. Straps and buckles are then used to affix the snowboard boot in place relative to the snowboard binding.

Alpine ski boots typically include a rigid sole plate for coupling to the ski binding. A toe flange of the sole plate is configured to first slide into a toe cap of the ski binding. When a heel portion of the sole plate is lowered into the heel portion of the ski binding, the heel portion activates the locking mechanism of the heel portion of the ski binding and the heel is locked into place.

A person engaging in snow sports may wish to go back and forth from alpine skiing to snowboarding during the day. However, changing boots is inconvenient and time-consuming. What is needed is an adapter for snowboard boots so that the snowboard boot may be safely used with an alpine ski binding without necessitating removal of the snowboard boot.

SUMMARY OF THE INVENTION

Several embodiments of the invention advantageously address the needs above as well as other needs by providing a ski binding adapter apparatus for a boot comprising: a back support configured to receive a calf portion of a boot; a sole plate configured to receive a sole of the boot, a heel end of the sole plate pivotally coupled to a lower end of the back support, a portion of the heel end of the sole plate configured to removably attach to an alpine ski binding, a toe portion of the sole plate configured to removably attach to the alpine ski binding; a flexible foot pad configured to rest on the top of the foot of the boot when the boot is received by the sole plate; at least two toe straps, each toe strap coupling a side of the foot pad to a side portion of the sole plate, whereby a toe portion of the boot is snugly encircled by the sole plate, the foot pad, and the toe straps when the sole of the boot is received by the sole plate; at least two ankle straps, each ankle strap coupling a side of the foot pad to a side portion of the sole plate, whereby an ankle portion of the boot is snugly encircled by the sole plate, the foot pad, and the ankle straps; when the sole of the boot is received by the sole plate; and a shin pad assembly comprising a shin pad interposed between two shin straps, each shin strap coupling the a side of the shin pad to a side of the back support, whereby a leg portion of the boot is snugly encircled by the back support, the shin pad, and the shin straps, wherein when the boot is received in the ski binding adapter apparatus and the boot is snugly encircled by the apparatus at the toe portion, the ankle portion, and the leg portion, the boot is configured for use with the alpine ski binding.

BRIEF DESCRIPTION OF THE DRAWINGS

The above and other aspects, features and advantages of several embodiments of the present invention will be more apparent from the following more particular description thereof, presented in conjunction with the following drawings.

Figure 1:
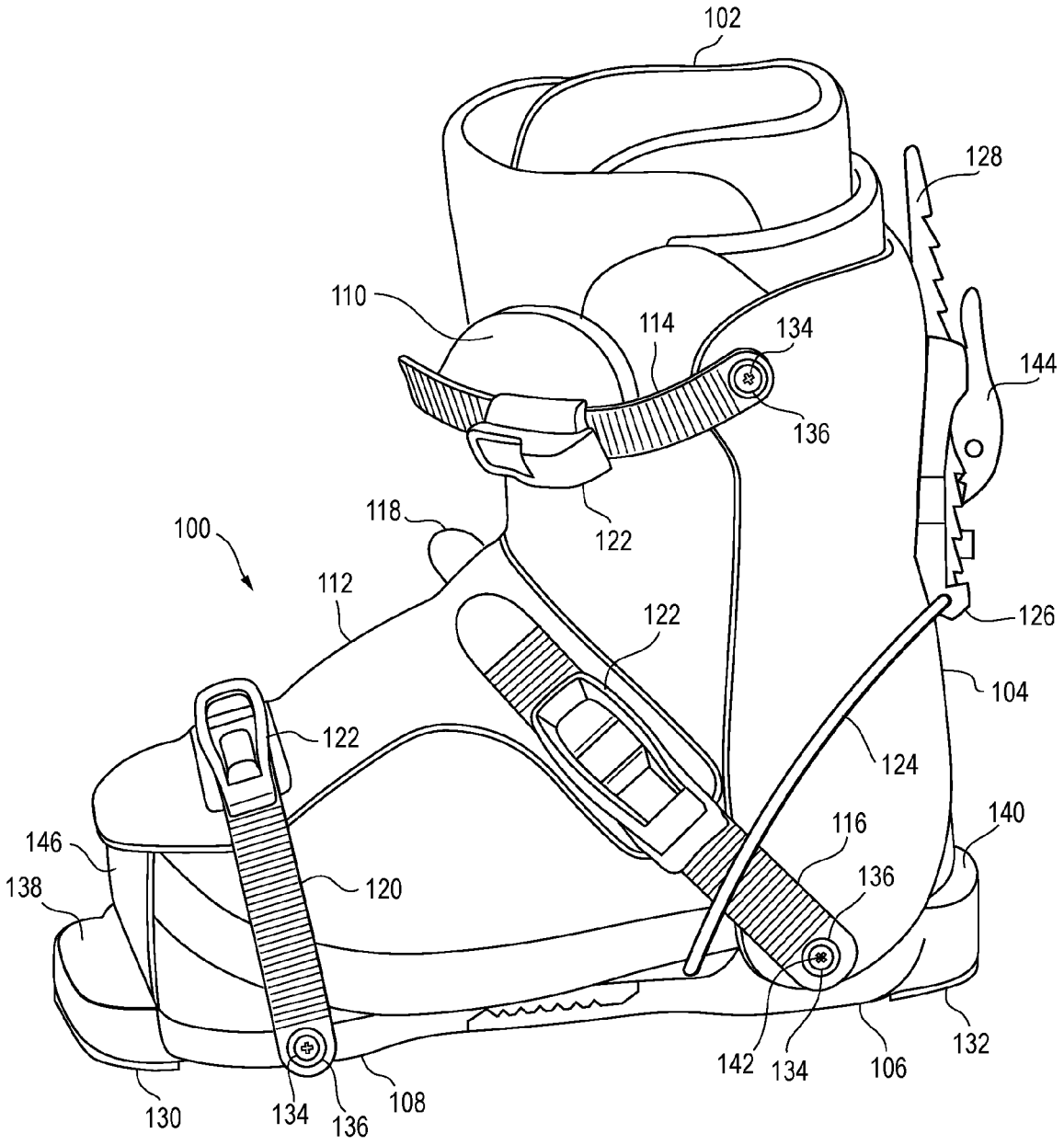
FIG. 1 is an outside perspective view of a left snowboard boot coupled to a left ski binding adapter apparatus in one embodiment of the present invention.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The following description is not to be taken in a limiting sense, but is made merely for the purpose of describing the general principles of exemplary embodiments. The scope of the invention should be determined with reference to the claims.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

While embodiments directed to a left shoe are described herein, it will be understood that embodiments for a corresponding right shoe will be mirrored as necessary.

The terminology "inside" refers to a side corresponding to an arch of a foot, and "outside" refers to the other side of the foot, i.e. opposite to the arch (in other terms, the outside side of the foot is the side of the foot most distal from a centerline going vertically though a person). The terms "toe" and "heel" correspond to the front and back of the foot, respectively. Longitudinal is used to refer to the toe-heel alignment, and transverse is used to refer to a direction crossing the foot, i.e. perpendicular to the longitudinal direction.

As referred to herein, applicable ISO and ASTM standards include at least ISO 14573 for Snowboard strap bindings for soft boots and ISO 5355 for Alpine Ski Boots. It will be understood that in other embodiments the invention may be modified for use with other standards snowboard boot and ski binding standards, for example ISO 11544 for Snowboard step-in bindings.

Figure 2:
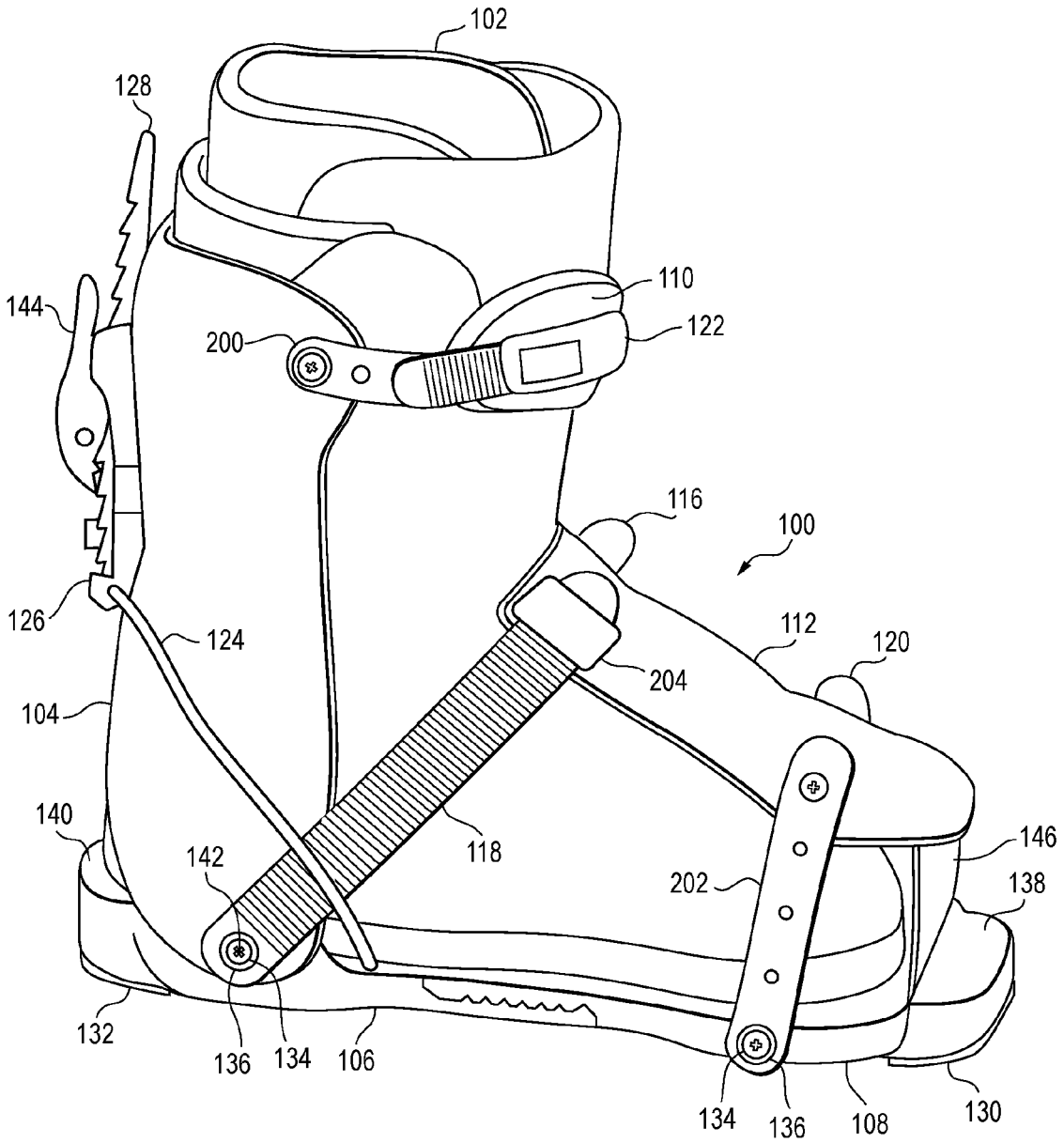
FIG. 2 is an inside perspective view of the left snowboard boot coupled the ski binding adapter apparatus of FIG. 1.

Referring first to FIGS. 1 and 2, an outside perspective view and an inside perspective view, respectively, of a snowboard boot 102 coupled to a ski binding adapter apparatus 100 are shown. Shown are a back support 104, a heel plate 106, a toe plate 108, a shin pad 110, a foot pad 112, a shin ladder strap 114, a first ankle ladder strap 116, a second b, a toe ladder strap 120, a plurality of ratchet buckles 122, a cable 124, a cable holder 126, a heel ladder strap 128, a toe sole plate 130, a heel sole plate 132, a plurality of fasteners 134 and a plurality of washers 136, a toe flange 138, a heel lip 140, a back support rotation axis 142, a heel ratchet buckle 144, a toe guide 146, a shin adjustable strap 200, a toe adjustable strap, and a ladder strap receiver 204.

Shown in FIGS. 1 and 2 are the left snowboard boot 102 coupled to a left ski binding adapter apparatus 100. As previously mentioned, the corresponding right snowboard boot and right ski binding adapter apparatus 100 are mirror images of the left snowboard boot 102 and the left ski binding adapter apparatus 100, respectively. In the present embodiment, the toe plate 108, the heel plate 106, and the back support 104 are symmetrical and are used for both the left and the right ski binding adapter apparatus. The snowboard boot in the present embodiment is configured for attachment to a snowboard binding of a snowboard. In some embodiments, the snowboard boot complies with at least one current standard governing boots for attaching to snowboard bindings, for example standard ISO 14573.

The rigid toe plate 108 removably coupled to the rigid heel plate 106 in the same plane forms a rigid sole plate assembly 500 of the ski binding adapter apparatus 100 with a top (boot-side) surface and a bottom (ski-side) surface. The sole plate assembly 500 has a general shape of a sole of a shoe or boot, and is configured to receive the sole of the snowboard boot 102 by stepping the snowboard boot 102 onto the top surface of the sole plate assembly 500, with a toe of the snowboard boot 102 proximate to the toe end of the sole plate assembly 500 and the heel of the snowboard boot 102 proximate to the heel end of the sole plate assembly 500. and the toe plate 108 includes the toe flange 138 at a toe end of the toe plate 108, the toe flange 138 configured to slide into and removably couple to an alpine ski binding in accordance with applicable ISO and ASTM specifications. In the present embodiment the apparatus 100 is fully compatible with ISO 5355 for Alpine Ski-boots. The heel plate 106 includes the raised heel lip 140 around a perimeter of the heel plate 106 at a heel end of the heel plate 106. The heel lip 140 is configured to prevent rearward motion of the snowboard boot 102 while coupled to the ski binding adapter apparatus 100, and is also configured to removably couple to the alpine ski binding in accordance with applicable ISO and ASTM specifications. The heel lip 140 also provides an attachment location for the back support 104 and the first and second ladder straps 116, 118. The sole plate assembly 500, including additional elements not visible in FIGS. 1 and 2, is described further in FIGS. 3-7.

The toe plate 108, the heel plate 106 and the back support 104 in the present embodiment are made from plastic using an injection molding process, but other types of materials and processes may be used.

The sole portion may be lengthened or shortened to accommodate different snowboard boot lengths. The lengthening is described further below in FIGS. 8 and 9.

Figure 3:
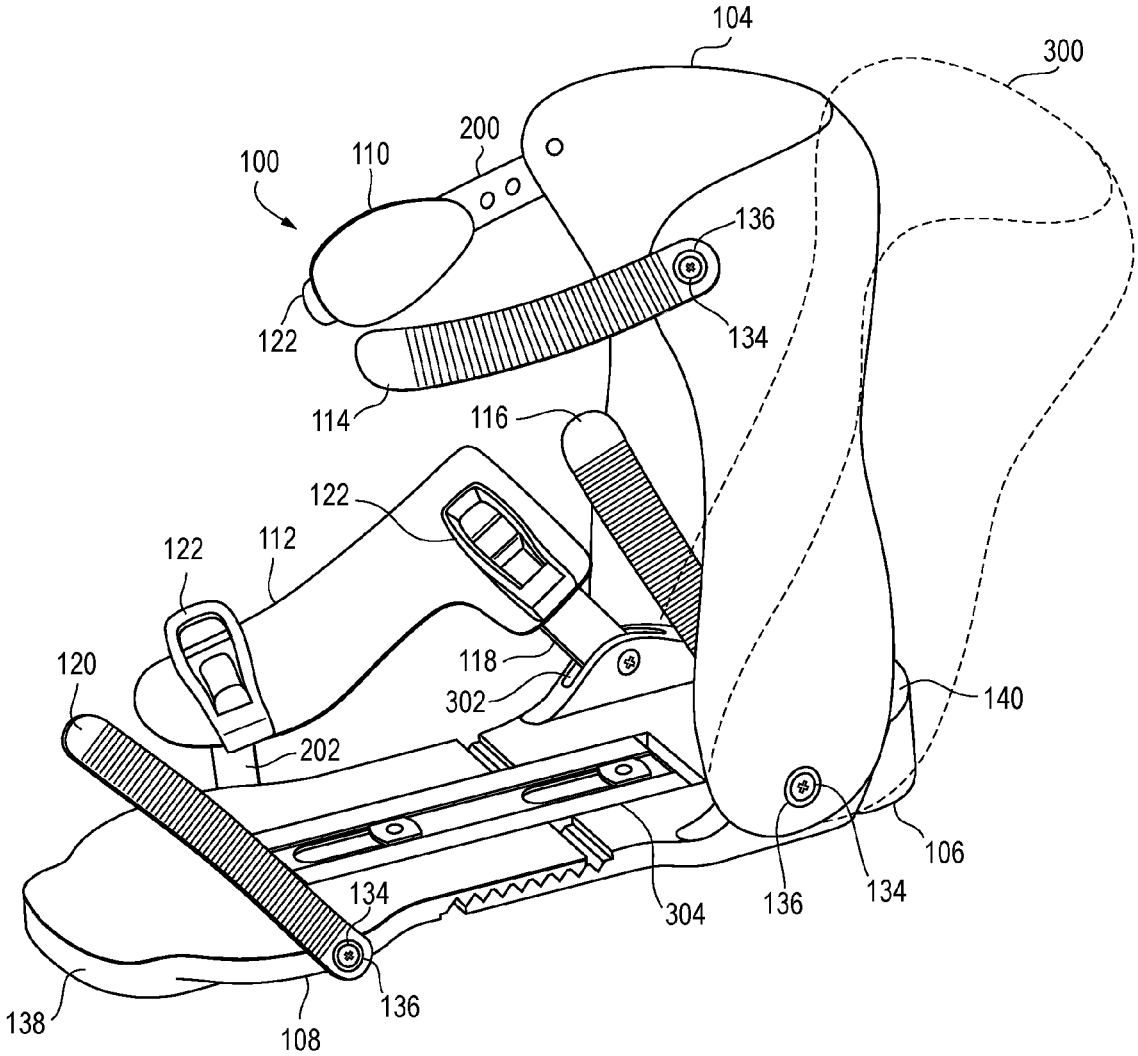
FIG. 3 is an outside perspective view of the left ski binding adapter apparatus in another embodiment of the present invention.
Figure 4:
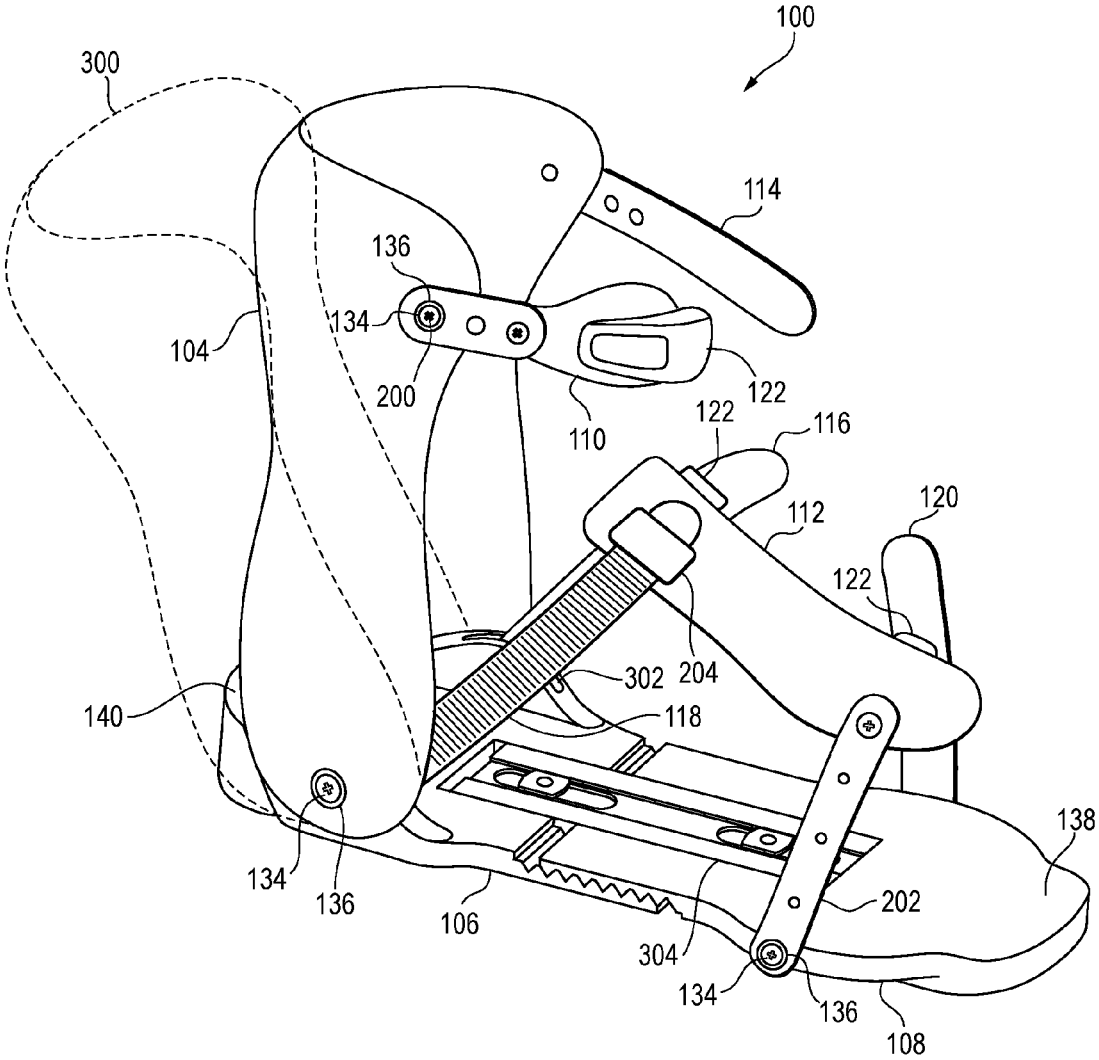
FIG. 4 is an inside perspective view of the left ski binding adapter apparatus of FIG. 3.

The back support is a generally vertically-oriented trough-shape (circular channel), with the open portion oriented towards the toe end of the apparatus 100 and configured to receive and partially encircle the calf portion of the snowboard boot, as shown in FIG. 1. A bottom end of the back support 104 is pivotally coupled to the heel portion at each side, allowing the back support 104 to rotate about the back support rotation axis 142 forwards towards the toe and rearwards past the heel. Each pivotal coupling in the present embodiment includes one fastener 134 and at least one washer 136, as shown in FIG. 1, although other suitable types of coupling, such as rivets, may be used. In some embodiments a pull strap or pull handle may be added to the exterior surface of the back support 104 to aid the use in entering and exiting the apparatus 100. The bottom end of the back support 104 includes an upward rounded notch proximate to the heel lip 140. The notch allows the back support 104 to clear the heel lip 140 when the back support 140 is rotated rearwards past the heel (as shown in FIGS. 3 and 4).

The toe plate 108 also includes the toe sole plate 130 coupled to the bottom surface at the toe end of the toe plate 108. The toe sole plate 130 comprises plastic with a low friction bearing surface configured to interface with the ski binding as specified by ISO 5355. The toe sole plate 130 provides a removable and replaceable wear plate for the toe engagement portion of the apparatus 100. Similarly, the heel plate 106 also includes the heel sole plate 132 coupled to the heel end of the heel plate 106. As with the toe sole plate 130, the heel sole plate 132 comprises plastic with the low friction bearing surface configured to interface with the ski binding as specified by ISO 5355. The heel sole plate 132 provides a removable and replaceable wear plate for the heel engagement portion of the apparatus 100.

An upper shin portion of the snowboard boot is restrained by a shin assembly comprising the shin ladder strap 114, the shin pad 110, and the shin adjustable strap 200. One end of the shin ladder strap 114 is pivotally coupled to an upper corner of the back support 104 at the outside side of the apparatus 100 via the fastener 134 and washer 136 or other suitable connection means. A portion of the shin ladder strap 114 distal to the back support 104 is removably and adjustably coupled to the shin pad 110 via the ratchet buckle 122, which is coupled to a portion of the shin pad 110 proximate to the shin ladder strap 114. The ratchet buckle 122, as typically known in the art, allows for locking of a ladder strap in place within the ratchet buckle 122, and further tightening of the ladder strap by ratcheting the ladder strap using the ratchet buckle 122. The ratchet buckle 122 is also configured to unlock from the ladder strap, whereby the ladder strap may be loosened or removed from the ratchet buckle 122. Various types of ratchet buckles 122 are known in the art, and any suitable type or variation of ratchet buckle 122 may be used in the ski binding adapter apparatus 100. The shin pad 110 is coupled to the upper corner of the back support 104 via the shin adjustable strap 200, which includes a plurality of holes along the strap for adjustment. When the shin ladder strap 114 is coupled to the shin pad 110, as shown in FIGS. 1 and 2, an upper shin portion of the snowboard boot is snugly encircled and restrained by the shin assembly in cooperation with the back support 104.

The shin pad 110 comprises foam interposed between two pieces of fabric, with a perimeter shape configured to provide attachment for the ratchet buckle 122 and the shin adjustable strap 200. The shin pad 110 may include interior stiffening pieces as required, for example at attachment points. In the present embodiment, the shin pad 110 is formed by sewing the foam and fabric assembly together, but other methods of attachment may be used, for example gluing. In other embodiments, the shin pad 110 may be comprised of only types of foam, of only types of fabric, or be made from other materials of suitable comfort, flexibility and strength.

A foot portion of the snowboard boot 102 is also restrained by a foot strap assembly comprising the foot pad 112, the first ankle ladder strap 116, the second ankle ladder strap 118, the toe ladder strap 120, the toe adjustable strap 202, the plurality of ratchet buckles 122, and the ladder strap receiver 204.

The foot pad 112 is removably and adjustably coupled to the sole plate assembly 500 by the straps 116, 118, 120, 202, the buckles 122 and the ladder strap receiver 204. The foot pad 112 rests on top of the foot portion of the snowboard boot 102, and is sized such that the foot pad covers most of the top of the foot portion of the snowboard boot 102. The first ankle ladder strap 116 and the second ankle ladder strap 118 are pivotally coupled to the heel plate 106 on a right and left side of the apparatus 100, respectively. In the present embodiment the coupling is through the same holes and uses the same fastener used for pivotal coupling of the back support 104 to the heel plate 106. The ankle ladder strap 116, 118 and the back support are pivotally coupled through the holes by the fastener 134 and at least one washer 136, although other couplings configured for some rotatable adjustment may be used. Using the same pivot point for the ankle ladder straps 116, 118 and the back support 104 allows for ideal placement of the foot pad 112 and improved isolation of the heel inside the snowboard boot 102.

In some embodiments the foot pad 112 may include a pull strap or pull handle to aid in adjusting of the foot pad 112 over the foot portion of the snowboard boot 102. The optional toe guide 146 may connect the toe portion of the foot pad 112 with the toe plate 108 at a location proximate to the toe end of the toe plate 108. The toe guide 146 may be used to prevent the snowboard boot 102 from moving further toe-ward within the ski binding adapter apparatus 100. The toe guide 146 is some embodiments is adjustable for length.

An upper end of the first ankle ladder strap 116 is removably and adjustably coupled to an upper outside side of the foot pad 112 by the ratchet buckle 122 coupled to the side of the foot pad proximate to the outside of the apparatus 100. An upper end of the second ankle ladder strap 118 is removably and adjustably coupled to the upper inside side of the foot pad 112 by the ladder strap receiver 204. The ladder strap receiver 204 provides incremental adjustment for the second ankle ladder strap 118, but for simplicity does not provide for the additional ratchet tightening, which for the top of the foot is provided by the ratchet buckle 122 coupled to the first ankle ladder strap 116.

An upper end of the toe ladder strap 120 is adjustably and removably coupled to a lower outside side of the foot pad 112 by the ratchet buckle 122 coupled to the side of the foot pad 112 proximate to the outside side of the apparatus 100. The toe adjustable strap 202 in the present embodiment has a plurality of holes along the length of the toe adjustable strap 202. A lowest hole is coupled to the toe plate 108 such that the toe adjustable strap 202 is pivotably coupled to the toe plate 108. An upper hole is coupled (pivotably or non-pivotably) to a lower inside side of the foot pad 112. Less adjustment is required at the inside toe location, so a ladder strap is not required and a simpler strap with holes, coupled with simple fasteners at both ends, may be used. The lower ends of the toe ladder strap 120 and the toe adjustable strap 202 are coupled to the outside side of the toe plate 108 at a location approximately 1" to the rear of the front portion of the toe plate 108 that is used to couple to the ski binding.

The heel ratchet buckle 144 is coupled to a heel exterior portion of the back support 104 and oriented to receive the heel ladder strap 128 feeding into the heel ratchet buckle 144 from below and out of the heel ratchet buckle 144 at the top (i.e. the heel ladder strap 128 is oriented generally vertically). A lower end of the heel ladder strap 128 is coupled to the cable holder 126. The cable holder 126 includes a horizontal though-hole configured to receive the cable 124. The cable 124 passes through the cable holder 126 through-hole, wraps around the exterior of the back support 104 at each side of the back support 104, and is coupled to the heel plate 106 at each side, such that the cable 124 is a general U-shape going around the exterior of the back support 104 and anchored at the inside side and the outside side of the heel plate. The cable 124 is a flexible metal cable approximately 1 mm in diameter.

The location of the cable 124 is adjusted by adjusting the vertical location of the cable holder 126 by using the heel ratchet buckle 144 to lower or raise the heel ladder strap 128. Raising of the cable holder 126 tightens the cable 124 around the back support 104 and therefore limits rearward rotation of the back support 104 about the back support rotation axis 142. This is desirable in order for an angle of the back support 104 with respect to the sole plate assembly 500 to not be greater than an angle of the calf portion of the snowboard boot 102 with respect to the sole portion of the snowboard boot 102.

When it is desirable for the back support 104 to be rotated rearward with respect to the sole plate assembly 500 (for example as shown in FIGS. 3 and 4), such as when the apparatus 100 is being mounted onto the snowboard boot 102, the heel ratchet buckle 144 is operated to allow the heel ladder strap 128 and cable holder 126 to slide downward. This loosens the cable 124 around the exterior of the back support 104 and allows the back support 104 to rotate freely rearwards with respect to the sole plate assembly 500.

Referring again to FIGS. 1 and 2, the ski binding adapter apparatus 100 adapts the snowboard boot 102 for use with the alpine ski binding so that the combination of the snowboard boot 102 and the ski binding adapter apparatus 100 engage with the ski binding and ensures proper release of the snowboard boot 102 in the apparatus 100 from the alpine ski binding (relative to torsional and longitudinal release from the alpine ski binding). The apparatus 100, when coupled to the snowboard boot 102 as previously described, provides the fit and tension needed to hold the snowboard boot 102 into the ski binding adapter apparatus 100, which is necessary for the functionality of the apparatus 100 when used with the snowboard boot 102.

The apparatus 100, when coupled to the snowboard boot 102, allows the alpine skier to adapt the standard snowboard boot 102 to the standard alpine ski binding, and also provides the ability for the user to easily place the snowboard boot 102 within the ski binding adapter apparatus 100, and also provides for various adjustments of fit for improved functionality of the snowboard boot 102 in the apparatus 100.

Placing the snowboard boot 102 in the ideal position relative to the apparatus 100 is important for the overall performance of the apparatus 100. The various adjustable portions of the apparatus 100, as previously described, enable the user to couple the apparatus 100 to the snowboard boot 102 in the ideal position for standard-compliant use with the ski binding. As snowboard boot 102 types and sizes vary, the adjustability provides a customized, reliable fit of the snowboard boot 102 to the apparatus 100.

The use of the ratchet buckles 122 for adjustability on the outside side of the apparatus 100 ensures that the proper amount of pressure is placed on the snowboard boot 102. Additionally, the user only needs to release one or both of the outside ankle ladder straps 116, 120 in order to release the foot pad 112 from the snowboard boot 102.

Referring next to FIGS. 3 and 4, the left ski binding adapter apparatus 100 in another embodiment of the present invention is shown in an unbuckled state, i.e. ready to be installed around the snowboard boot 102. Shown are the back support 104, the heel plate 106, the toe plate 108, the shin pad 110, the foot pad 112, the shin ladder strap 114, the first ankle ladder strap 116, the second ankle ladder strap 118, the toe ladder strap 120, the plurality of ratchet buckles 122, the plurality of fasteners 134, the plurality of washers 136, the toe flange 138, the heel lip 140, shin adjustable strap 200, the toe adjustable strap 202, the ladder strap receiver 204, a back support rotated position 300, a strap slot 302, and a top plate 304.

The embodiment of FIGS. 3 and 4 differs from the embodiment of FIGS. 1 and 2 in that the first ankle ladder strap 116 and the second ankle ladder strap 118 are located on an interior side of the back support 104, as opposed to the embodiment of FIGS. 1 and 2, where the ankle ladder straps 116, 118 pass outside the exterior of the back support 104. Each ankle ladder strap 116, 118 is coupled to the heel plate 106 by being inserted into one strap slot 302 which is configured to allow the ankle ladder strap 116, 118 to rotate at the connection for adjustability.

FIGS. 3 and 4 show the ski binding adapter apparatus 100 in the state ready to be installed around the snowboard boot 102 (not shown). The shin ladder strap 114 has been uncoupled from the shin pad 110 by pressing a lever on the ratchet buckle 122 coupled to the shin pad 110.

The toe ladder strap 120 and the first ankle ladder strap 116 have been similarly uncoupled from the foot pad 112. The back support 104 may be rotated rearwards, as indicated by the back support rotated position 300, to allow better access for the user to place the snowboard boot 102 into the apparatus 100. It should be noted that the back support 104 may be rotated further rearwards than shown in FIGS. 3 and 4. In the embodiment shown, the upwards rounded notch of the back support 104 allows the back support 104 to clear the heel lip 140 as the back support 104 is rotated rearwards resulting in a possible rearwards rotation of more than 90 degrees from vertical, i.e. such that a portion of the back support 104 is lower than the sole plate assembly 500.

In some cases, the user may prefer to leave the toe ladder strap 120 and the first ankle ladder strap 116 coupled to the foot pad 112, and instead loosen the ladder straps 116, 120 in the ratchet buckles 122.

In use, the user inserts the toe of the snowboard boot 102 underneath the foot pad 112 and drops the heel of the snowboard boot 102 so that the sole of the snowboard boot 102 is resting on the sole plate assembly 500. The back support 104 may initially be in a rearward rotated position to allow the heel and leg portion of the snowboard boot 102 to be more easily fit into the apparatus 100.

The toe ladder strap 120 and the first ankle ladder strap 116 are coupled to the ratchet buckles 122 if they are not already coupled to the ratchet buckles 122. The shin ladder strap 114 is coupled to the shin pad ratchet buckle 122. As the shin ladder strap 114 is tightened to snugly encircle the snowboard boot 102, the back support 104 is rotated forwards and engages the calf portion of the snowboard boot 102. Typically, for use in the ski binding, the back support 104 will be rotated slightly forwards of vertical. In typical embodiments the rotation requirement is easily met by the rotation range of the back support 104 about the back support rotation axis 142. In the present embodiment, the back support 104 is configured to rotate forward towards the toe end up to approximately 45 degrees. In practice, users will generally rotate the back support 104 forwards about 5-15 degrees.

The toe ladder strap 120 and the first ankle ladder strap 116 are also shortened using the ratchet buckles 122 such that the toe and ankle portions of the snowboard boot 102 are snugly and securely encircled. When the ratchet buckles are properly tightened, the snowboard boot 102 does not move within the apparatus 100 and when the apparatus 100 is coupled to a ski binding, the user can ski as if the user were wearing a conventional ski boot.

Figure 8:
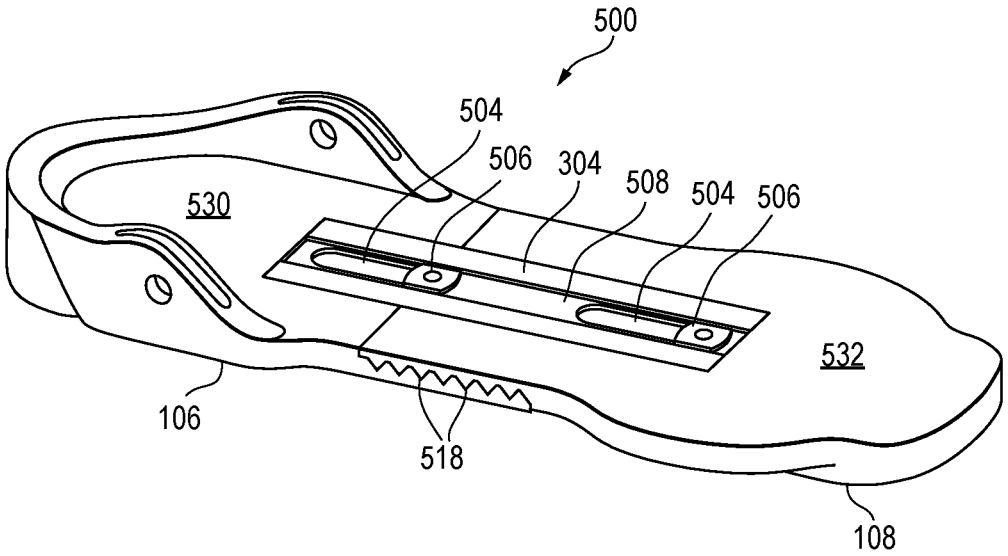
FIG. 8 is a perspective view of a non-extended sole plate assembly.
Figure 9:
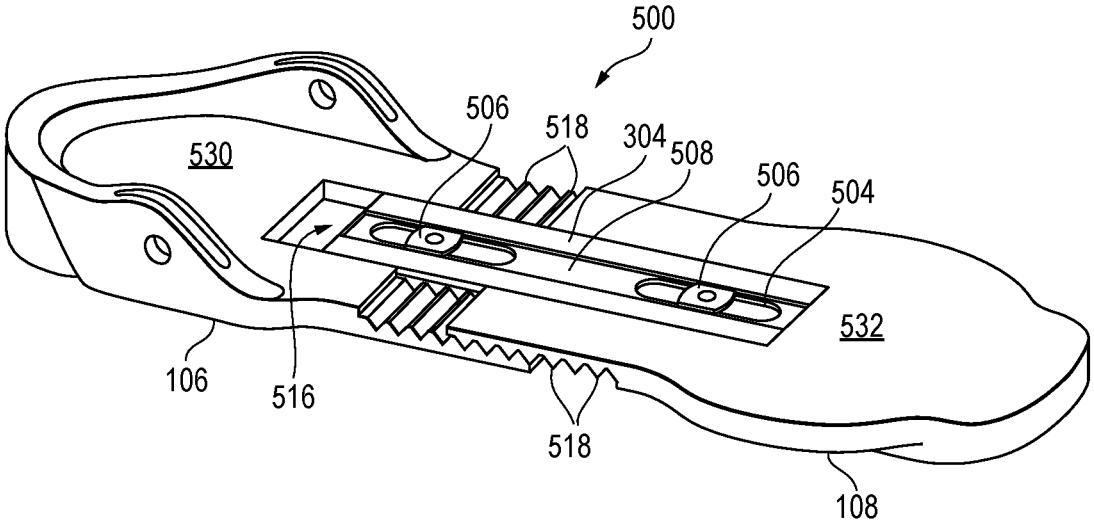
FIG. 9 is a perspective view of a partially extended sole plate assembly 500.

The sole plate assembly 500 may also be adjusted for length, as shown in FIGS. 8 and 9. Further strap adjustments may be made using the holes in the shin adjustable strap 200, the toe adjustable strap 202. The length of the ankle ladder strap 118 may be adjusted using the ladder strap receiver 204.

Referring again to FIGS. 3 and 4, the various adjustable portions of the apparatus 100 are used to provide easy and quick access for the user to place the snowboard boot 102 into the apparatus 100. The adjustable portions are the tightened and adjusted as required for a tight fit of the apparatus 100 to the snowboard boot 102. The foam of the foot pad 112 applies even pressure to the outside of the snowboard boot 102 for comfort.

Once the apparatus 100 has been adjusted for fit around the user's particular snowboard boot 102, only the ratchet buckles 122 on the shin pad 110 and the ankle portion of the foot pad 112 of the apparatus 100 need to be released in order for the user to remove the snowboard boot 102 from the apparatus 100, and the apparatus 100 retains the proper adjustment for the next time the user uses the apparatus 100. Additionally, the location of the ratchet buckles 122 on the outside side of the apparatus 100 ensures that there is no interference between ratchet buckles 122 for the left foot and the right foot.

Figure 5:
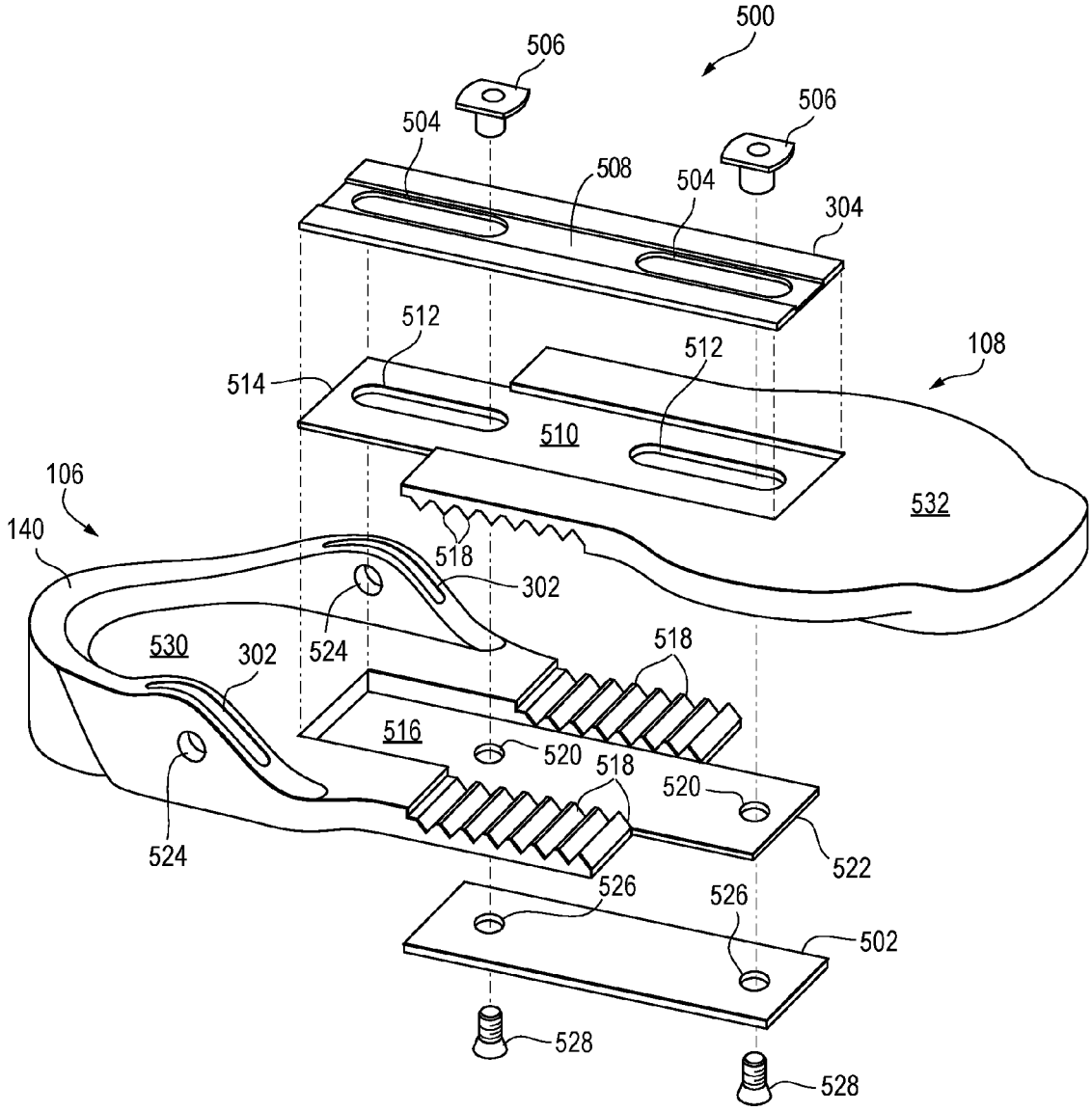
FIG. 5 is an exploded view of a sole plate assembly 500 of the ski binding adapter apparatus.

Referring next to FIG. 5, an exploded view of the sole plate assembly 500 is shown. Shown are the heel plate 106, the toe plate 108, the heel lip 140, the strap slots 302, the top plate 304, a bottom plate 502, a plurality of top plate fastener slots 504, flanged nuts 506, a top plate recess 508, an upper toe plate recess surface 510, toe plate fastener slots 512, a toe plate projection 514, an upper heel plate recess surface 516, a plurality of teeth 518, heel plate holes 520, a heel plate projection 522, heel lip holes 524, bottom plate holes 526, screws 528, a heel plate upper surface 530 and a toe plate upper surface 532.

The heel plate 106 includes the raised heel lip 140 extending around the perimeter of the heel plate generally corresponding to a heel area of the snowboard boot 102. The heel lip 140 includes one horizontal heel lip hole 524 proximate to each end of the heel lip 140 for use in the pivotal coupling of the back support 104 and the ankle ladder straps 116, 118. The heel lip holes 524 are located proximate to the anatomical ankle of the user during use of the apparatus 100. In the embodiment shown, the heel lip 140 includes the vertical strap slot 302 proximate to each end and intersecting with the corresponding heel lip hole 524, such that the lower end of the corresponding ankle ladder strap 116, 118 may be inserted into the strap slot 302 and pivotally fastened to the heel lip 140 by a fastener 134 through the heel lip hole 524. The strap slots 302 also have a horizontal length longer than the width of the ankle ladder strap 116, 118 to allow for pivotal movement of the ankle ladder strap 116, 118.

The flat portion of the heel plate 106 includes the rectangular heel plate projection 522 centered transversely in the heel plate 106 extending outward from an end of the heel plate 106 at the toe-end of the heel plate 106. A rectangular portion of the heel plate 106, including the heel plate projection 522 and extending heel-wards, is recessed down from the heel plate upper surface 530 and comprises the upper heel plate recess surface 516. The upper heel plate recess surface 516 extends the same width as the heel plate projection 522. The portion of the heel plate 106 including the upper heel plate recess surface 516 includes the circular heel plate holes 520. One heel plate hole 520 is located proximate to the toe-end of the heel plate projection 522, and one heel plate hole 520 is located proximate to the heel-ward extent of the upper heel plate recess surface 516. The heel plate holes 520 are transversely centered in the upper heel plate recess surface 516.

The heel plate 106 includes the plurality of teeth 518 pointing upwards and located on either side of a portion of the upper heel plate recess surface 516. The teeth are oriented transversely on the heel plate 106. In the present embodiment, the number of teeth 518 on each side is between 2 and 10. The peaks of the teeth 518 are higher than the upper heel plate recess surface 516 but lower than the heel plate upper surface 530.

The toe plate 108 is generally flat, and includes the rectangular toe plate projection 514 centered transversely in the toe plate 108 extending outward from an end of the toe plate 108 at the heel-end of the toe plate 108. A rectangular portion of the toe plate 108, include the toe plate projection 514 and extending toe-wards, is recessed down from the toe plate upper surface 532 and comprises the upper toe plate recess surface 510. The extent of the upper toe plate recess surface 510 is configured to match the upper heel plate recess surface 516, so that in a shortest configuration of the sole plate assembly 500, the toe plate 108 is plated on top of the heel plate 106 such that the extent of the upper toe plate recess surface 510 fits within and aligns with the extent of the upper heel plate recess surface 516 located directly underneath the upper toe plate recess surface 510, as indicated by the dashed lines in FIG. 5.

The portion of the toe plate 108 including the upper toe plate recess surface 510 includes the two elongated toe plate fastener slots 512, which are oriented in the longitudinal direction and centered in the transverse direction, so that when the toe plate 108 is placed on the heel plate 106, each heel plate hole 520 is accessible through one toe plate fastener slot 512.

The toe plate 108 also includes the teeth 518 on the underside of the toe plate 108, located and configured to mesh with the upward-facing teeth 518 of the heel plate 106. The teeth 518 of the toe plate are similar to the teeth 518 of the heel plate 106, with the exception that the top plate teeth 518 are pointing downwards. The teeth 518 of the toe plate 108 are the same number as the teeth 518 of the heel plate 106. When the upper heel plate recess surface 516 is aligned with the upper toe plate recess surface 510, the teeth areas are also aligned, i.e. each lower tooth 518 is meshed with an upper tooth 518 and the sole plate assembly 500 is a continuous thickness proximate to and at the tooth areas, as shown in FIGS. 1, 2 and 8.

The rectangular top plate 304 matches the plan dimensions of the upper toe plate recess surface 510 and has a thickness generally matching the difference between the toe plate upper surface 532 and the upper toe plate recess surface 510, such that when the top plate 304 is placed on the upper toe plate recess surface 510, an upper surface of the top plate 304 is generally aligned with the toe plate upper surface 532. The top plate 304 includes the top plate recess 508 down the longitudinal center of the top plate 304. The depth and width of the top plate recess 508 matches the depth and width of the flanged nut 506 so that the top surface of the flange of the flanged nut 506 is aligned with the top plate upper surface, and the flanged nut 506 may be longitudinally slid within the top plate recess 508. The top plate 304 also includes the top plate fastener slots 504, configured in size and location to match the toe plate fastener slots 512 when the top plate 304 is placed on the toe plate 108. The top plate fasteners slots 504 are located within the top plate recess 508 so that the flanged nut 506 (and corresponding screw 528) can pass through both the top plate fastener slot 504 and the toe plate fastener slot 512 when the top plate 304 is placed on the toe plate 108. The top plate 304 comprises aluminum or other suitably strong and rigid material.

Figure 6:
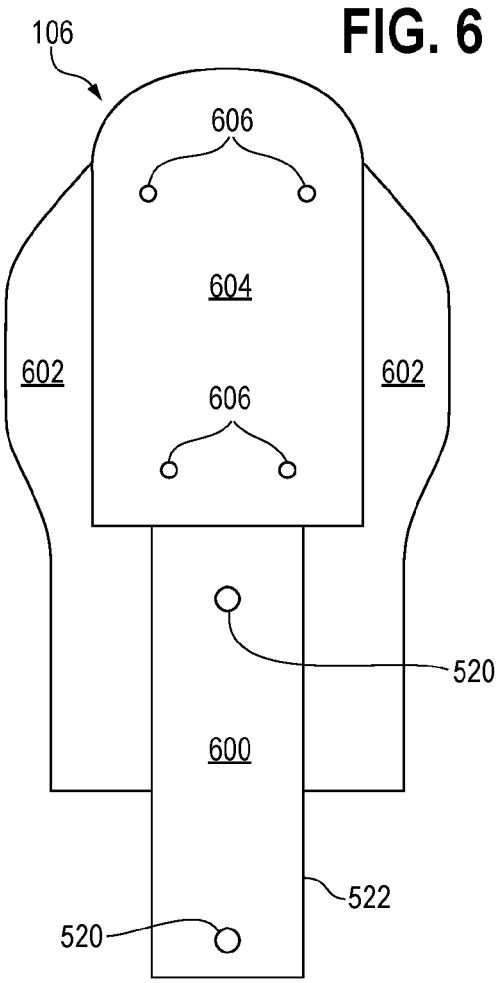
FIG. 6 is a plan view of an underside of a heel plate of the sole plate assembly 500.

The rectangular bottom plate 502 matches the plan dimensions of a lower heel recess surface 600 on an underside of the heel plate 106 as shown in FIG. 6. The bottom plate 502 is generally the thickness of a difference between a lower heel plate surface 602 (as shown in FIG. 6) and the lower heel recess surface 600. The bottom plate 502 includes the two circular bottom plate through-holes 526, of size and location to match the heel plate holes 520 when the bottom plate 502 is set into the lower heel recess surface 600. The bottom plate holes 526 may be countersunk on the lower heel recess surface 600. The bottom plate 502 comprises aluminum or other suitably strong and rigid material.

As shown in FIG. 5, when assembled, the sole plate assembly 500 includes a heel-side portion of the toe plate 108 overlapping a toe-side portion of the heel plate 106 such that at least two teeth 518 of the heel plate 106 mesh with at least two teeth 518 of the toe plate 108. The toe plate projection 514 thereby fits the recessed portion of the heel plate 106. The top plate 304 is then placed on the upper toe plate recess surface 510 of the toe plate 108, and the bottom plate 502 is placed on the lower heel recess surface 600 of the underside of the heel plate 106. In this way, a portion of the toe plate 108 and a portion of the heel plate 106 are interposed between the top plate 304 and the bottom plate 502. The fastener slots 504 512 are aligned with the plate holes 520, 526 such that a screw 528 and a flanged nut 506 are used to rigidly couple the assembly at each set of holes 520, 526. The elongated fastener slots 504 512 allow for the longitudinal adjustment of the sole plate assembly 500, as shown below in FIGS. 8 and 9.

Referring next to FIG. 6, a plan view of an underside of the heel plate 106 of the sole plate assembly 500 is shown. Shown are the heel plate holes 520, the heel plate projection 522, the lower heel recess surface 600, a lower heel plate surface 602, a lower heel plate raised surface 604, and a plurality of blind holes 606.

The underside of the heel plate 106 has three generally parallel surfaces. The lowest surface is the lower heel recess surface 600. The lower heel recess surface 600 corresponds to the upper heel plate recess surface 516 on the upper side of the heel plate 106. The lower heel recess surface 600 includes the heel plate projection 522 and the heel plate holes 520. The lower heel plate surface 602 is higher than the lower heel recess surface 600 such that when the bottom plate 502 is fitted into the lower heel recess surface 600, as shown in FIG. 5, the surface of the bottom plate 502 generally aligns with the lower heel plate surface 602.

A portion of the heel plate 106 corresponding to a general area underneath the heel is raised further, forming the lower heel plate raised surface 604. The lower heel plate raised surface 604 includes the plurality of blind holes 606 (four in the embodiment shown) and is configured to couple to the heel sole plate 132 shown in FIGS. 1 and 2, in the present embodiment by driving screws through the heel sole plate 132 and into the blind holes 606. In some embodiments the lower heel plate raised surface 604 may include a perimeter lip whereby the heel sole plate 132 fits within the lip whereby the heel sole plate 132 is inset within the perimeter lip.

Figure 7:
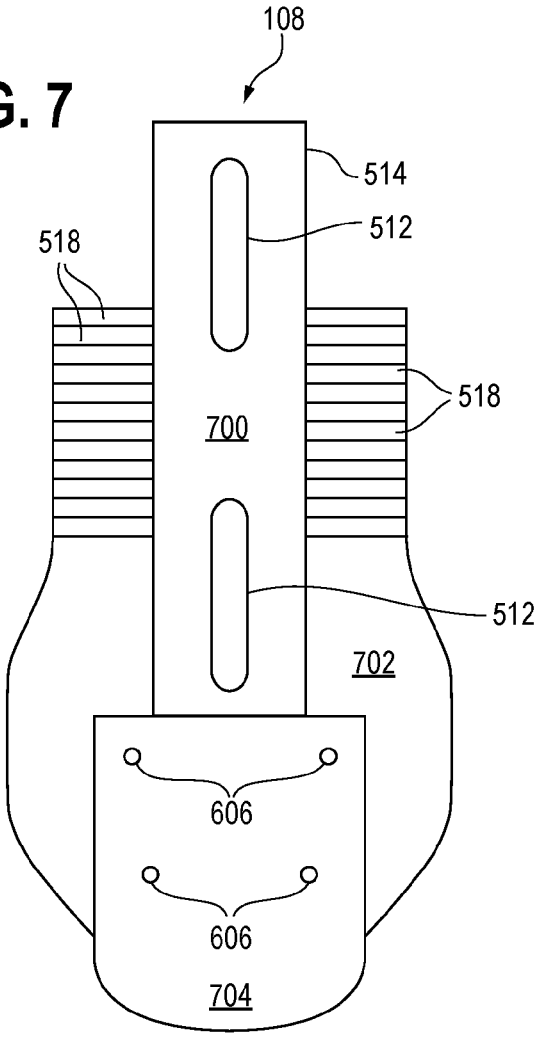
FIG. 7 is a plan view of an underside of a toe plate of the sole plate assembly 500.

Referring next to FIG. 7, a plan view of an underside of the toe plate 108 of the sole plate assembly 500 is shown. Shown are the toe plate fastener slots 512, the toe plate projection 514, the plurality of teeth 518, a lower toe plate recess surface 700, a lower toe plate surface 702, a lower toe plate raised surface 704, and the plurality of blind holes 606.

Similarly to the heel plate 106, the underside of the toe plate 108 has three generally parallel surfaces (not considering the teeth 518). The lowest surface is the lower toe plate recess surface 700. The lower toe plate recess surface 700 corresponds to the upper toe plate recess surface 510 on the upper side of the toe plate 108. The lower toe plate recess surface 700 includes the toe plate projection 514 and the toe plate fastener slots 512. The lower toe plate surface 702 is higher than the lower toe plate recess surface 700 such that when the toe plate 108 is fitted onto the heel plate 106, as shown in FIG. 5, the portion of the heel plate 106 including the upper heel plate recess surface 516 is inset within the recess formed between the toe plate lower surface 700 and the lower toe plate recess surface 700. When the bottom plate 502 is set on the lower heel recess surface 600, the surface of the bottom plate 502 generally aligns with the lower toe plate surface 702.

Also shown in FIG. 7 are the plurality of teeth 518 on the underside of the toe plate 108, configured to mesh with the corresponding teeth 518 of the heel plate 106, as shown in FIGS. 5, 8 and 9.

A portion of the toe plate 108 corresponding to a general area underneath the toe and ball of foot is raised further, forming the lower toe plate raised surface 704. The lower toe plate raised surface 704 includes the plurality of blind holes 606 (four in the embodiment shown) and is configured to couple to the toe sole plate 130 shown in FIGS. 1 and 2, in the present embodiment by driving screws through the toe sole plate 130 and into the blind holes 606. In some embodiments the lower toe plate raised surface 704 may include a perimeter lip whereby the toe sole plate 130 fits within the lip whereby the toe sole plate 130 is inset within the perimeter lip.

Referring next to FIG. 8, a perspective view of a non-extended sole plate assembly 500 is shown. Shown are the heel plate 106, the toe plate 108, the top plate 304, the top plate fastener slots 504, the flanged nuts 506, the heel plate upper surface 530, the toe plate upper surface 532, and the teeth 518.

As previously shown in FIGS. 1 and 2, in the non-extended position the heel plate upper surface 530 and the toe plate upper surface 532 are contiguous, and the top plate 304 completely covers the upper heel plate recess surface 516. The teeth 518 of the heel plate 106 and the toe plate 108 are all fully meshed, and there is no underside gap between the toe plate 108 and the heel plate 106. The flanged nuts 506 (coupled to the screws 528) are located in the toe-most portion of the top plate fastener slots 504 to line up with the holes 520, 526 below. The engagement of the teeth 518 locks the toe plate 108 to the heel plate 106, and the tightening of the screws 528 in the flanged nuts 506 keep all of the elements of the sole plate assembly 500 in engagement. As a result, the sole plate assembly 500 is a rigid and strong assembly suitable for the stresses exerted on the sole plate assembly 500 during skiing.

Referring next to FIG. 9, a perspective view of a partially extended sole plate assembly 500 is shown. Shown are the heel plate 106, the toe plate 108, the top plate 304, the top plate fastener slots 504, the flanged nuts 506, the top plate recess 508, the heel plate upper surface 530, the toe plate upper surface 532, the upper heel plate recess surface 516, and the teeth 518.

To extend the length of the sole plate assembly 500 and provide a customized fit while still maintaining the rigidity and strength of the sole plate assembly 500, the toe plate 108 is moved outward from the heel plate 106 such that only a portion of the teeth 518 overlap, as shown in FIG. 9. The top plate 304 moves forward with the toe plate 108, resulting in a gap between the heel plate upper surface 530 and the toe plate upper surface 532, and exposing some of the teeth 518 of the heel plate 106.

While the toe plate 108 and the top plate 304 have moved forward, the locations of the heel plate holes 520 and the bottom plate holes 526 remain in the same location, so a center portion of the top plate fastener slots 504 is used in order to keep the vertical alignment allowing the elements of the sloe plate assembly to be coupled together using the screws 528 and the flanged nuts 506. The top plate recess 508 allows for the flanges of the flanged nuts 506 to slide in the top plate fastener slots 504 with the top surface of the flanged nuts 506 generally equal to the upper surface of the top plate 304 and the toe plate upper surface 532.

As with FIG. 8, the engagement of the teeth 518 and the tightening of the screws 528 in the flanged nuts 506 maintains the strength and rigidity of the assembly while allowing the overall length to be increased. The nesting of various elements (such as the top plate 304 within the toe plate 108, the toe plate projection 514 within the recess of the upper heel plate recess surface 516, the heel plate projection 522 within the recess formed by the lower heel recess surface 600, and the bottom plate 502 within the recess formed by the lower toe plate recess surface 700) also locks together the sole plate assembly 500 into a single rigid unit. The use of metal for the top plate 304 and the bottom plate 502 provides additional stiffness and rigidity to the center portion of the sole plate assembly 500, especially for the extended condition.

Figure 10:
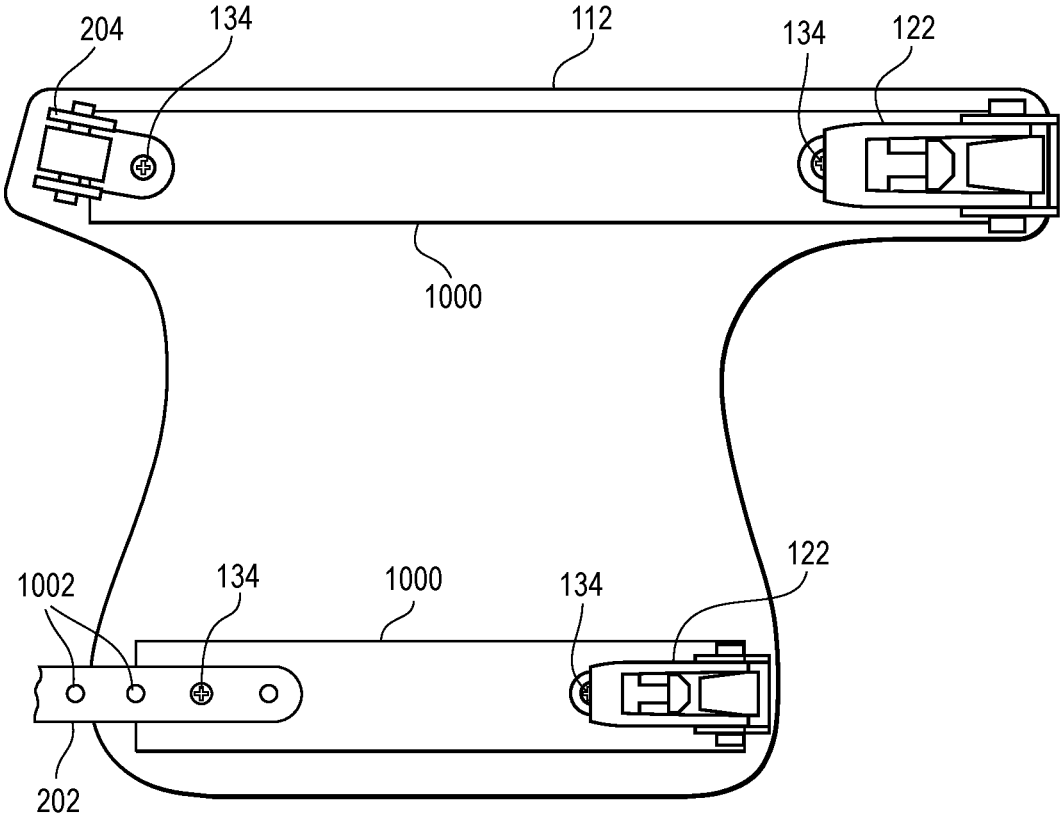
FIG. 10 is a flattened top view of a foot pad assembly of the left ski binding adapter apparatus.

Referring next to FIG. 10, a flattened top view of the foot pad 112 of the apparatus 100 for the left snowboard boot 102 is shown. Shown are the foot pad 112, two ratchet buckles 122, the ladder strap receiver 204, the toe adjustable strap 202, a plurality of fasteners 134, and stiffeners 1000.

The foot pad 112 is a generally rectangular shape with rounded corners and lateral extensions at the top (ankle) portion of the foot pad 112. The foot pad 112 in the present embodiment comprises foam interposed between two pieces of fabric. The foam has a thickness to be comfortable for the user and protect the user's foot from any protrusions from other parts of the foot pad assembly. The assembly of the foot pad 112 includes gluing the foam to each piece of fabric and sewing the foam and fabric assembly at least proximate to an outer perimeter of the foot pad 112. In other embodiments, the shin pad 110 may be comprised of only foam, of only fabric, or be made from other materials of suitable comfort, flexibility and strength.

The foot pad 112 includes the two stiffeners 1000. Each stiffener 1000 extends generally horizontally across the foot pad 112, one at the ankle side and one at the toe side. The stiffeners 1000 in the present embodiment comprise a flexible bar portion covered by a fabric portion. The fabric portion is sewn to the foot pad 112, whereby the stiffeners 1000 are coupled to the foot pad 112. The stiffeners 1000 are in a curved shape generally matching the curve of the top of the foot portion of the snowboard boot 102, aiding in the conforming of the foot pad 112 to the top of the foot of the snowboard boot 102. The stiffeners 1000 also provide a strengthened portion for attachment of the fasteners 134 fastening the ratchet buckles 122, the ladder strap receiver 204, and the toe adjust able strap.

At the upper ankle portion of the foot pad 112, the ladder strap receiver 204 on the left side (corresponding to the inside side of the apparatus 100) is coupled to the foot pad 112 by at least one fastener 134 and is configured for receiving the second ankle ladder strap 118. The ratchet buckle 122 on the right side (the outside side) at the upper ankle portion of the foot pad 112 is coupled to the foot pad 112 by at least one fastener 134 and is configured for receiving the first ankle ladder strap 116. The ratchet buckle 122 and the ladder strap receiver 204 are coupled to the foot pad 112 via the stiffener 1000 at the ankle portion of the foot pad 112.

At the lower toe portion of the foot pad 112, the toe adjustable strap 202 on the left side includes a plurality of holes 1002. The toe adjustable strap 202 is coupled to the foot pad 112 via one fastener 134 passing through one of the holes 1002. The toe adjustable strap 202 is adjustable by unfastening the toe adjustable strap 202 and refastening using another of the holes 1002.

At the right side of the lower toe portion (the outside side), the ratchet buckle 122 is coupled to the foot pad 112 by at least one fastener 134 and is configured for receiving the toe ladder strap 120. The rather buckle 122 and the toe adjustable strap 202 are coupled to the foot pad 112 via the stiffener 1000 at the toe portion of the foot pad 112.

Although the preceding description contains significant details of the various straps and buckles used to modify and adjust the position of the foot pad 112 and the back support 104, it should not be construed as limiting the scope of the invention, but rather as providing illustrations of the preferred embodiments of the invention. As an example, a system of cables and ratcheting pulleys could also be used to change the position of the foot pad 112. A similar system could also be used to tighten the adjustable foot pad 112 around the snowboard boot 102 ensuring a proper fit with the apparatus 100. A system such as the Boa Closure System could be used for this purpose. Thus the scope of the invention should be fixed by the following claims rather than any specific examples provided.

While the invention herein disclosed has been described by means of specific embodiments, examples and applications thereof, numerous modifications and variations could be made thereto by those skilled in the art without departing from the scope of the invention set forth in the claims.

What is claimed is:

1. A ski binding adapter apparatus for a boot comprising:

a back support configured to receive a calf portion of a boot;

a sole plate configured to receive a sole of the boot, a heel end of the sole plate pivotally coupled to a lower end of the back support, a heel lip at the heel end of the sole plate configured to torsionally and longitudinally release from an alpine ski binding, a toe flange at a toe end of the sole plate configured to torsionally and longitudinally release from the alpine ski binding and configured to slide into and removably couple to the alpine ski binding;

a flexible foot pad configured to rest on a top of a foot portion of the boot when the boot is received by the sole plate;

at least two toe straps, each toe strap coupling a side of the foot pad to a side portion of the sole plate, whereby a toe portion of the boot is snugly encircled by the sole plate, the foot pad, and the toe straps when the sole of the boot is received by the sole plate;

at least two ankle straps, each ankle strap coupling a side of the foot pad to a side portion of the sole plate, whereby an ankle portion of the boot is snugly encircled by the sole plate, the foot pad, and the ankle straps; when the sole of the boot is received by the sole plate; and a shin pad assembly comprising a shin pad interposed between two shin straps, each shin strap coupling the a side of the shin pad to a side of the back support, whereby a leg portion of the boot is snugly encircled by the back support, the shin pad, and the shin straps, wherein when the boot is received in the ski binding adapter apparatus and the boot is snugly encircled by the apparatus at the toe portion, the ankle portion, and the leg portion, the boot is configured for use with the alpine ski binding.

2. The ski binding adapter apparatus for the boot of claim 1, wherein the boot is configured for attachment to snowboard bindings.

3. The ski binding adapter apparatus for the boot of claim 1, wherein a length of at least one ankle strap is adjustable.

4. The ski binding adapter apparatus for the boot of claim 3, wherein the ankle straps are ladder straps.

5. The ski binding adapter apparatus for the boot of claim 4, wherein at least one adjustable ankle strap is coupled to the foot pad by a ratchet buckle.

6. The ski binding adapter apparatus for the boot of claim 4, wherein at least one adjustable ankle strap is coupled to the foot pad by a ratchet buckle.

7. The ski binding adapter apparatus for the boot of claim 1, wherein a length of at least one toe strap is adjustable.

8. The ski binding adapter apparatus for the boot of claim 7, wherein at least one toe strap is a ladder strap.

9. The ski binding adapter apparatus for the boot of claim 8, wherein at least one adjustable toes trap is coupled to the foot pad by a ratchet buckle.

10. The ski binding adapter apparatus for the boot of claim 1, further comprising a cable with a first end coupled to a left side of the sole plate and a second end coupled to a right side of the sole plate, and a middle portion of the cable adjustably coupled to a back portion of the back support, whereby the adjustable coupling moves in a vertical direction, whereby the adjustable coupling is configured to prevent rearward rotation of the back support.

11. The ski binding adapter apparatus for the boot of claim 10, wherein the adjustable coupling includes a heel ladder strap coupled to a ratchet buckle.

12. The ski binding adapter apparatus for the boot of claim 1, the sole plate further comprising a heel plate adjustably coupled to a toe plate, whereby a length of the sole plate is adjustable.

13. The ski binding adapter apparatus for the boot of claim 12, the heel plate and the toe plate each including a portion with a plurality of teeth whereby the heel plate teeth are configured to engaged with the toe plate teeth, whereby the length of the sole plate is adjusted by changing the extent of the engaged teeth.

14. The ski binding adapter apparatus for the boot of claim 1, the sole plate including a raised lip around a perimeter of a heel portion of the sole plate.

15. The ski binding adapter apparatus for the boot of claim 1, wherein the foot pad and the shin pad comprise foam.

16. The ski binding adapter apparatus for the boot of claim 1, wherein the back support and the sole plate comprise plastic.

* * * * *